US007985031B2

(12) United States Patent
Balcan et al.

(10) Patent No.: US 7,985,031 B2
(45) Date of Patent: Jul. 26, 2011

(54) GUIDE RAIL FOR CARRIAGE PRINTER

(75) Inventors: Petrica D. Balcan, San Diego, CA (US); Del R. Doty, Carlsbad, CA (US)

(73) Assignee: Eastman Kodak Company, Rochester, NY (US)

( * ) Notice: Subject to any disclaimer, the term of this patent is extended or adjusted under 35 U.S.C. 154(b) by 841 days.

(21) Appl. No.: 11/969,288

(22) Filed: Jan. 4, 2008

(65) Prior Publication Data

US 2009/0175669 A1 Jul. 9, 2009

(51) Int. Cl.
*B41J 11/22* (2006.01)

(52) U.S. Cl. ..... 400/354; 400/352

(58) Field of Classification Search ..... 400/354, 400/352

See application file for complete search history.

(56) References Cited

U.S. PATENT DOCUMENTS

| | | | | |
|---|---|---|---|---|
| 4,034,842 | A | 7/1977 | Giacone | |
| 4,566,814 | A * | 1/1986 | Papp et al. | 400/354.1 |
| 5,368,403 | A | 11/1994 | Broder et al. | |
| 6,520,633 | B2 | 2/2003 | Nakamura | |
| 6,616,354 | B2 * | 9/2003 | O'Hara et al. | 400/56 |
| 6,695,436 | B2 * | 2/2004 | Jang et al. | 347/49 |
| 6,742,865 | B2 | 6/2004 | Yusef et al. | |
| 7,314,265 | B2 * | 1/2008 | Sato | 347/37 |
| 7,695,100 | B2 * | 4/2010 | Matsuyama et al. | 347/37 |

* cited by examiner

*Primary Examiner* — Anthony H. Nguyen
(74) *Attorney, Agent, or Firm* — William R. Zimmerli

(57) ABSTRACT

A printer includes a carriage and a channel for guiding the carriage along a path. The carriage includes a protrusion extending from the carriage. The channel includes a first wall and a second wall. The first and second walls are opposed to each other. The protrusion of the carriage extends between the first wall and the second wall. A first portion of the protrusion is in contact with the first wall and a second portion of the protrusion is in contact with the second wall.

22 Claims, 4 Drawing Sheets

GUIDE RAIL FOR CARRIAGE PRINTER

FIELD OF THE INVENTION

This invention relates generally to carriage-style printers, and more particularly to the carriage guide along which the carriage is moved during printing.

BACKGROUND OF THE INVENTION

In a conventional carriage-style printer, the paper (or other recording medium) is successively advanced such that a portion of the paper is located within a print zone. While the paper is held stationary, a printhead is moved along the print zone in a direction that is substantially perpendicular to the paper advance direction, and marks are made by the printhead on the paper in the print zone as the printhead moves past.

An example of such a carriage style printer is an inkjet printer, where the printhead includes an array of nozzles arranged in a direction substantially parallel to the paper advance direction, and the print zone within which printing may be done corresponds to the region between the two endmost nozzles in the array. The printhead and at least a portion of the ink supply for the printhead are typically located on a carriage which moves back and forth along a carriage guide rail. In a commonly used printer architecture, the print zone is horizontal and the printhead nozzles are located vertically above the paper in the print zone. For good image quality, it is important to keep the nozzles at a constant distance from the paper in the print zone. This means that 1) the carriage should be mounted at such an angle that the two endmost nozzles are substantially the same distance from the print zone, and 2) the carriage guide rail should be straight and substantially parallel to the print zone.

In conventional carriage-style printers, the carriage guide rail is a precision ground steel round rod, and the carriage includes a corresponding rounded recess which rides along the round rod. The carriage guide rail bears the weight of the carriage and is primarily responsible for the accurate travel of the carriage. A second rail, the anti-rotation rail or slider rail, is used to make contact with a second part of the carriage in order to fix the carriage rotational orientation about the carriage guide rail axis. The anti-rotation rail may be a second round rod, but it may be made more cost effectively out of sheet metal (see, for example, U.S. Pat. No. 5,368,403). While this round rod design works well, the precision ground steel round rod is more expensive than desired. Therefore, it is desirable to form not only the anti-rotation rail, but also the carriage guide rail using sheet metal.

U.S. Pat. Nos. 6,520,633 and 6,742,865 describe a variety of carriage guide rail (or track) configurations made from formed, bent or extruded metal or plastic. In each of the rail configurations, a recess (or receptor groove) is formed in the carriage with a configuration sized and shaped to correspond to the rail configuration. The rail and receptor groove configurations can be undesirably complex and/or require too much space in the printer.

In another prior art carriage guide rail formed of bent metal, the rail has a bottom horizontal wall and a vertical wall extending up from the horizontal wall, and the carriage has a projection which rides on the horizontal wall and the vertical wall. However, gravity tends to rotate the carriage in such a way as to tend to pull the projection out of contact with the vertical wall, so that a bias spring is required in order to keep the projection against the vertical wall.

Thus, for a low-cost printer to have improved image quality, there is a need for an improved carriage guide rail configuration which enables low cost, compact design, reduced complexity in carriage and rail design, uniform printhead to print zone spacing, low wear, and stable carriage motion.

SUMMARY OF THE INVENTION

According to one aspect of the present invention, a printer includes a carriage and a channel for guiding the carriage along a path. The carriage includes a protrusion extending from the carriage. The channel includes a first wall and a second wall. The first and second walls are opposed to each other. The protrusion of the carriage extends between the first wall and the second wall. A first portion of the protrusion is in contact with the first wall and a second portion of the protrusion is in contact with the second wall.

According to another aspect of the present invention, a method of disposing a carriage of a printer in a printing orientation includes providing a carriage including a protrusion extending from the carriage; providing a channel for guiding the carriage along a path, the channel including a first wall and a second wall, the first and second walls being opposed to each other; and causing the protrusion of the carriage to extend between the first wall and the second wall such that a first portion of the protrusion is in contact with the first wall, and a second portion of the protrusion is in contact with the second wall.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
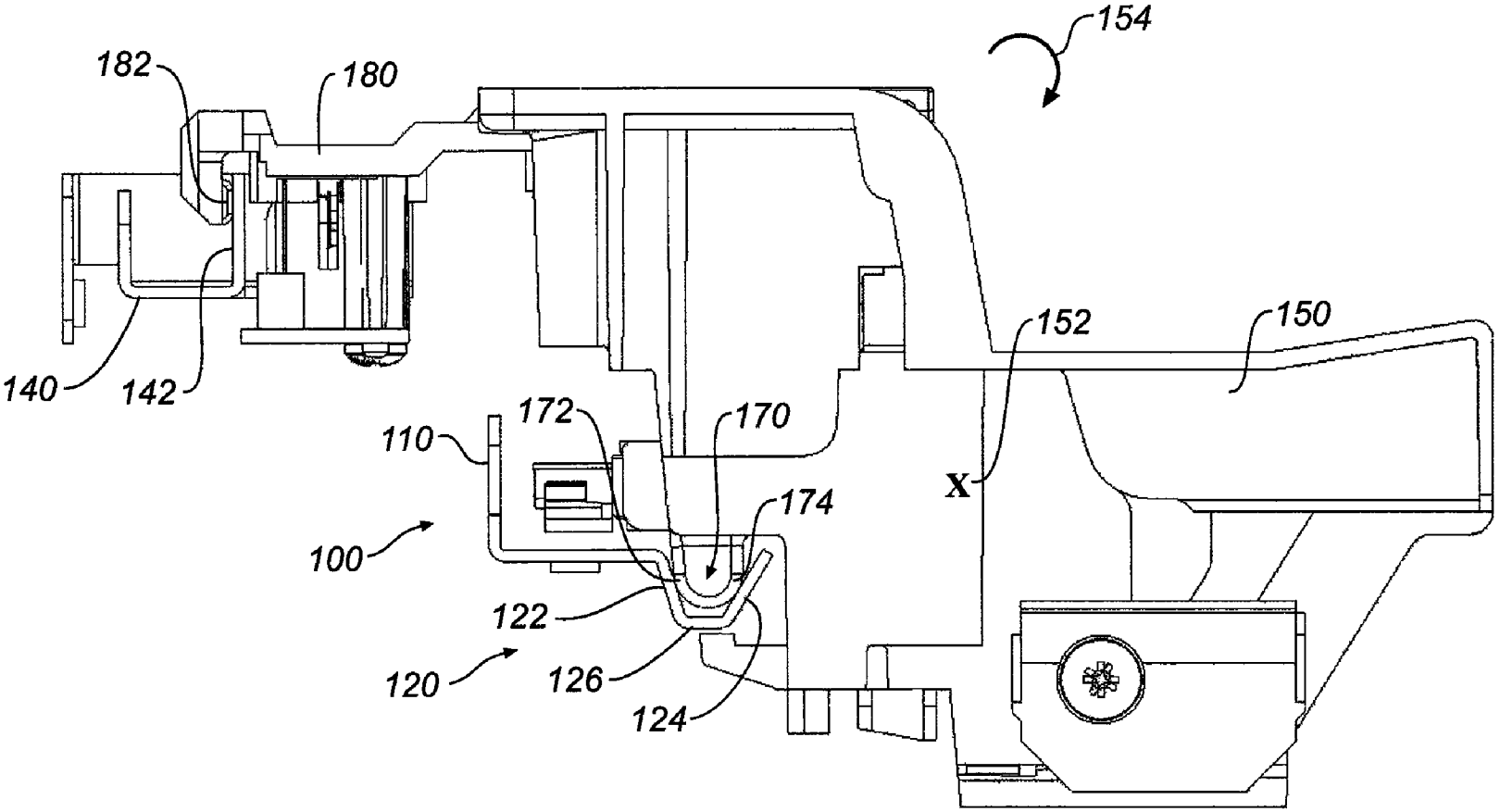
FIG. 1 shows an end view of a carriage, a carriage guide rail, and a rotation-limiting rail.
Figure 2:
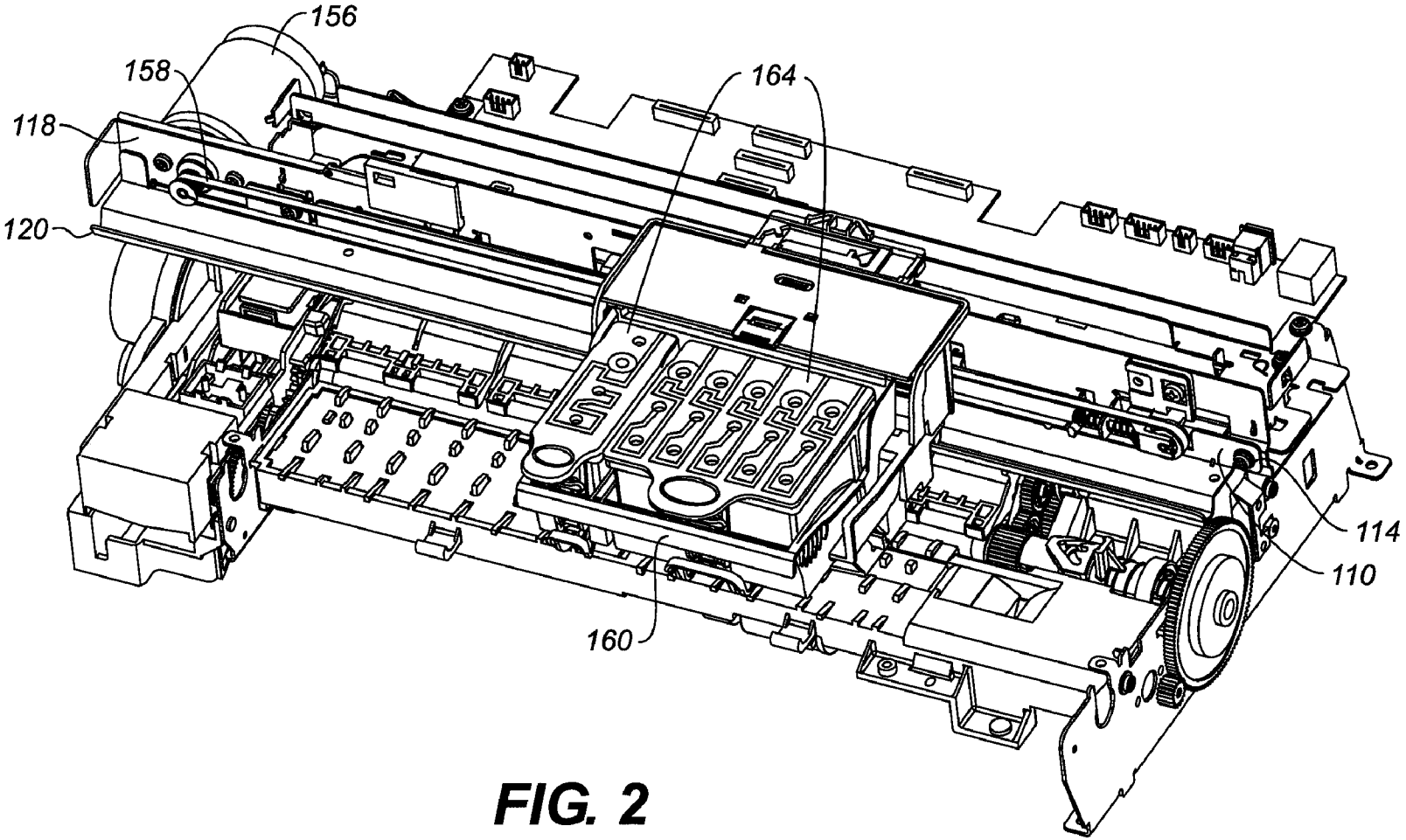
FIG. 2 shows a perspective view in which the carriage and the carriage guide rail are mounted in the printer.
Figure 4:
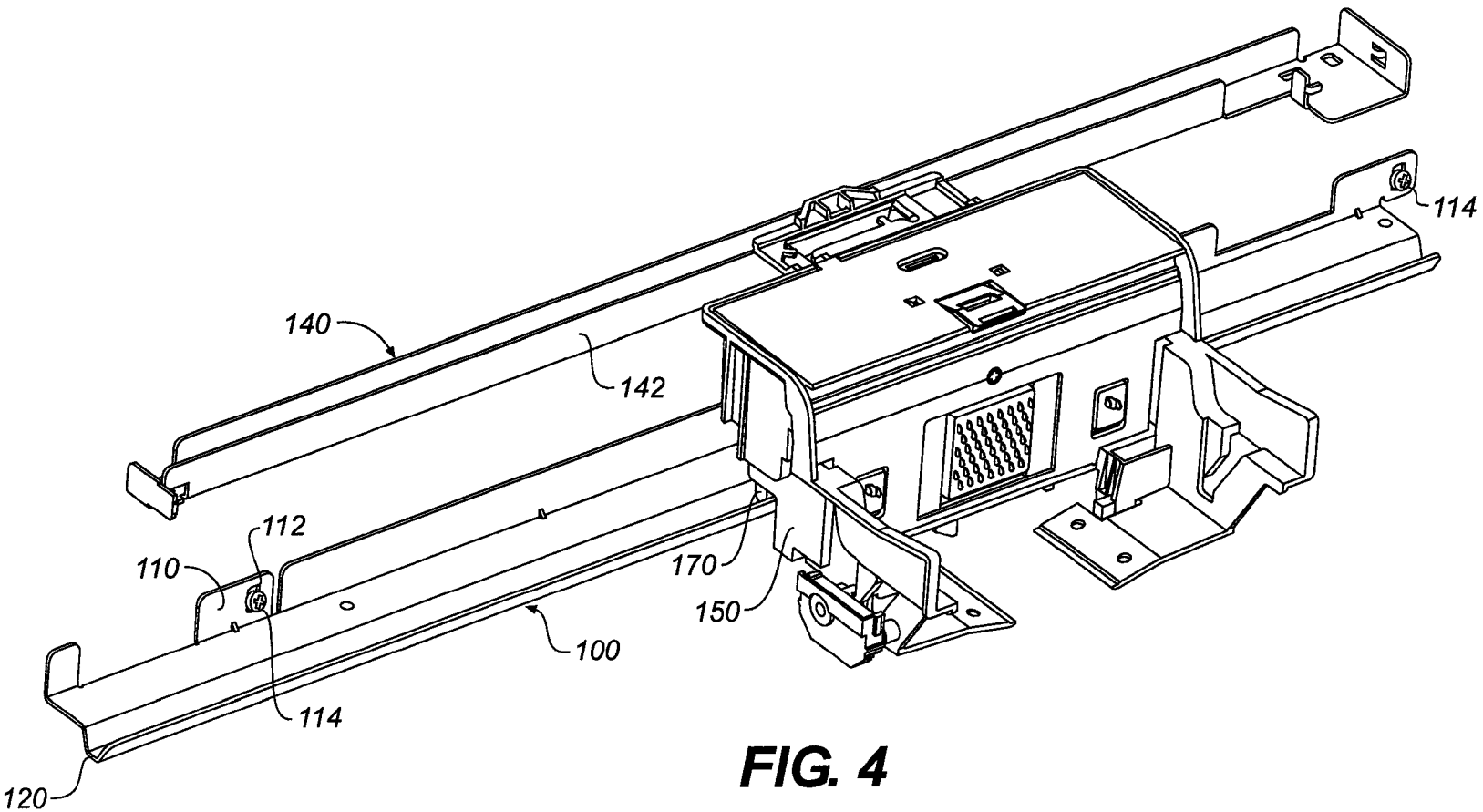
FIG. 4 shows a perspective view of the carriage, the carriage guide rail and the rotation-limiting rail.

Referring to FIGS. 1, 2, and 4, a carriage and a carriage guide rail are shown. Carriage guide rail 100 includes a mounting surface 110, by which the guide rail can be attached to the printer, and a guide channel portion 120 which guides the motion of the carriage. Guide channel portion 120 is somewhat V-shaped, including a first wall 122 which is opposed to a second wall 124. Guide channel portion 120 also can include a bottom wall 126 as seen in the example of FIGS. 1, 2, and 4. Alternatively, opposing walls 122 and 124 may intersect with each other without a bottom wall between them. Carriage 150 holds printhead 160 and ink supply 164 (shown in FIG. 2 but omitted in the other views for clarity). A carriage motor 156 and belt 158 move the carriage back and forth over the print zone. Carriage 150 includes a protrusion 170 which extends from the carriage body, preferably in a downward direction. Protrusion 170 rides along guide channel portion 120 to maintain the spacing between the printhead nozzles and the print zone below (not shown) in FIG. 1. Small regions on opposite sides 172 and 174 of protrusion 170 make contact with corresponding opposing walls 122 and 124 of the guide channel portion 120. Preferably protrusion 170 is rounded at and near the regions of contact, in order to help it seat properly in the channel as it rotates forward into position as described below. Preferably the protrusion 170 does not contact the bottom wall 126 of guide channel portion 120. Thus, it is the uniform spacing of the two opposing walls and not the position of the bottom wall that determines the height of the printhead above the print zone.

Optionally a lubricant (not shown) is applied between the protrusion 170 and opposing walls 122 and 124 to provide low-friction movement of the carriage and less wear. The lubricant may take the form of a grease, an oil, a dry lubricant (such as graphite or molybdenum disulfide) or other such applied medium. Alternatively, the lubricant may be applied as a vacuum deposited surface, or as a film or tape.

Figure 3:
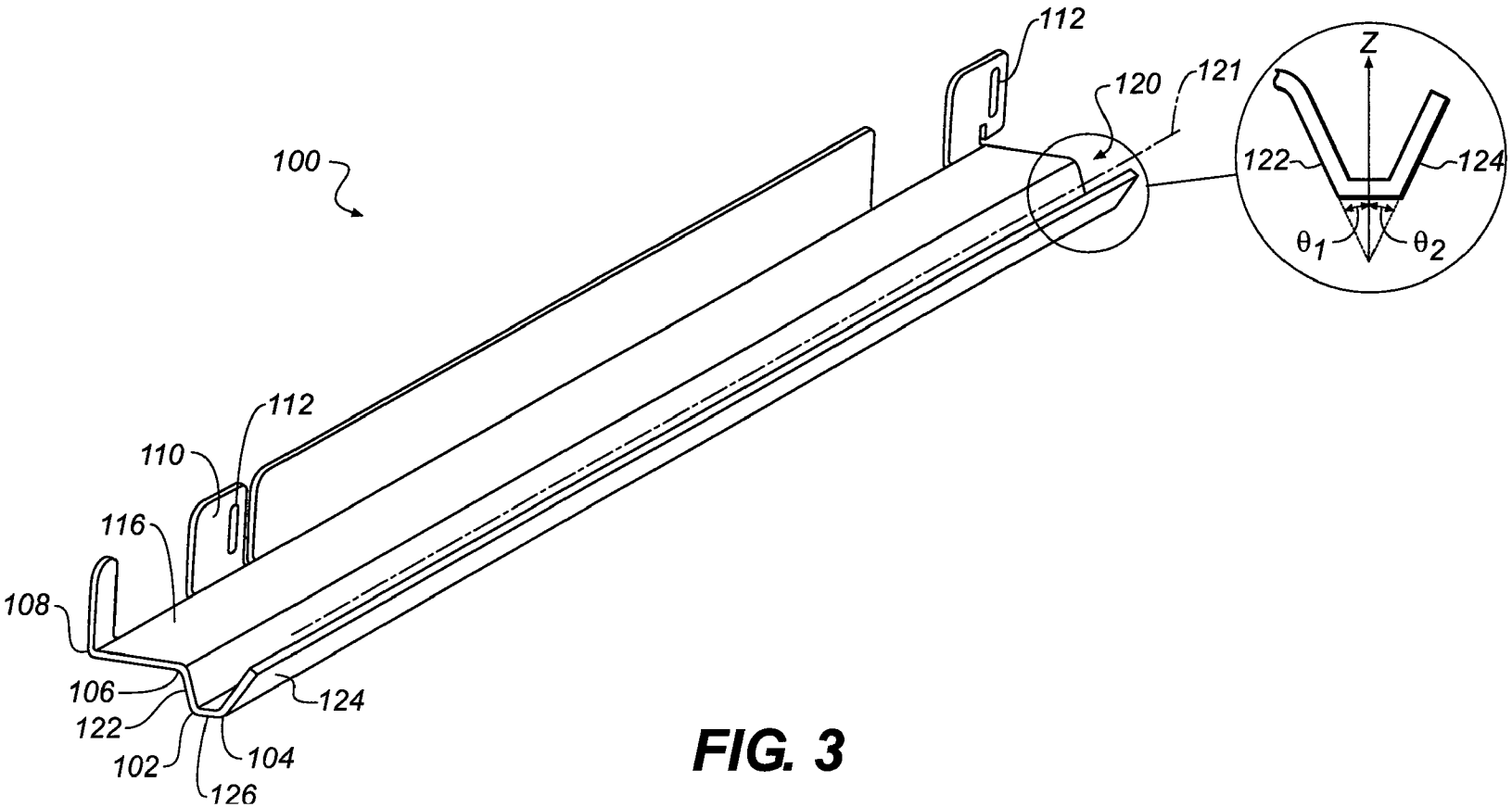
FIG. 3 shows a perspective view of an example embodiment of the carriage guide rail.

Referring to FIG. 3 and back to FIGS. 1 and 4, in order to keep the carriage 150 at a constant rotational orientation about the guide channel portion axis 121 (denoted in the FIG. 3 perspective view of an embodiment of guide rail 100), a rotation-limiting extension 182 from the rear 180 of the carriage 150 rides against wall 142 of an rotation-limiting rail 140. A lubricant is also optionally applied along wall 142 to provide low friction with respect to extension 182. In the example shown in FIG. 1, wall 142 is vertical or approximately vertical. The force of gravity causes sides 172 and 174 to stay in contact with opposing walls 122 and 124 of guide channel portion 120. The carriage is designed such that the protrusion 170 and the extension 182 are both located on the same side of the center of gravity 152 of the carriage 150 (at least when the center of gravity 152 includes printhead 160 and ink supply 164 being mounted on the carriage). Because the center of gravity 152 of carriage 150 is forward of protrusion 170, gravity also causes the carriage 150 to rotate forward in the direction of curved arrow 154 until extension 182 is in contact with wall 142 of rotation-limiting rail 140. Thus, no forces other than gravity are needed to hold the cartridge 150 level and at a uniform spacing from the paper as it rides along guide channel portion 120 and rotation-limiting rail 140.

Opposing walls 122 and 124 are disposed at an angle $\theta$ with respect to one another. In the event that there is a bottom wall 126, the angle $\theta$ between opposing walls 122 and 124 is defined to be the angle between the walls if the walls were extended until they intersected. The angle $\theta$ is chosen such that the carriage is kept from lifting as it moves back and forth along the guide channel portion 120, and also such that wear of the protrusion and/or the walls is kept small. The preferred angle depends on the carriage mass (including the printhead and ink supply), but typically the angle $\theta$ between the opposed walls is less than 120 degrees, and in a particular example the preferred angle $\theta$ was found to be approximately 60 degrees. Furthermore, when the printer and carriage are in an orientation for printing (e.g. the printer is sitting on a horizontal base), the first opposed wall 122 is within 60 degrees of being vertical and the second opposed wall 124 is also within 60 degrees of being vertical (where vertical is denoted in FIG. 3 by arrow Z). In other words, if $\theta_1$ is the angle between first wall 122 and vertical, and if $\theta_2$ is the angle between the second wall 124 and vertical (such that $\theta_1+\theta_2=\theta$), then both $\theta_1$ and $\theta_2$ are less than 60 degrees. The opposed walls 122 and 124 may be symmetrically angled about the vertical direction, but optionally the angles with respect to vertical may not be equal. In the particular example cited above, both the first wall 122 and the second wall 124 were within 45 degrees of being vertical. Bottom wall 126 is approximately horizontal in the example.

As shown in FIG. 3, the carriage rail 100 has a relatively simple shape that may be formed by punching holes in a sheet of metal and bending the metal in multiple places. The example embodiment shown in FIG. 3 includes bends in four places. The bend along line 102 is between first wall 122 and bottom wall 126. The bend along line 104 is between second wall 124 and bottom wall 126. The bend along 106 is between first wall 122 and surface 116. The bend along line 108 is between surface 116 and mounting surface 110. All four bends are parallel to axis 121 of guide channel portion 120 and both mounting surface 110 and surface 116 extend parallel to axis 121. In the example shown in FIG. 3, mounting surface 110 has two holes 112 through which screws 114 (shown in FIG. 4) can be inserted to fasten carriage guide rail 100 to a vertical wall 118 in the printer. The holes are slotted in the example shown in FIG. 3, which allows the height of the nozzles above the print zone to be adjusted during printer assembly. Alternatively, holes could be formed in surface 116 and screws could be inserted to fasten carriage guide rail 100 to a horizontal wall in the printer.

The invention has been described in detail with particular reference to certain preferred embodiments thereof, but it will be understood that variations and modifications can be effected within the scope of the invention.

PARTS LIST

100 Carriage guide rail
102 Bend
104 Bend
106 Bend
108 Bend
110 Mounting surface
112 Holes
114 Screws
116 Surface
118 Vertical wall in printer
120 Guide channel portion
121 Axis of guide channel portion
122 First opposing wall
124 Second opposing wall
126 Bottom wall
140 Rotation-limiting rail
142 Wall of rotation-limiting rail
150 Carriage
152 Center of gravity of carriage
154 Curved arrow
156 Carriage motor
158 Belt
160 Printhead
164 Ink supply
170 Protrusion from carriage
172 Side of protrusion
174 Side of protrusion
180 Rear of carriage
182 Extension from rear of carriage

The invention claimed is:

1. A printer comprising:

a carriage including a protrusion extending from the carriage; and a channel for guiding the carriage along a path, the channel including a first wall and a second wall, the first and second walls being opposed to each other, the protrusion of the carriage extending between the first wall and the second wall, a first portion of the protrusion being in contact with the first wall, and a second portion of the protrusion being in contact with the second wall; the channel further comprising a third wall connecting the first wall and the second wall.

2. The printer of claim 1, wherein the first and second portions of the protrusion are curved.

3. The printer of claim 1, the first wall being disposed at a first angle with respect to vertical and the second wall being disposed at a second angle with respect to vertical, wherein the first angle and the second angle are each less than 60 degrees when the carriage is disposed in a printing orientation.

4. The printer of claim 1, the first wall being disposed at a first angle with respect to vertical and the second wall being disposed at a second angle with respect to vertical, wherein the first angle and the second angle are each less than 45 degrees when the carriage is disposed in a printing orientation.

5. The printer of claim 1, wherein the first wall and the second wall are positioned at a non-perpendicular angle relative to each other.

6. The printer of claim 1, wherein gravity acts as a biasing mechanism to keep the protrusion of the carriage in contact with the first and second walls of the channel.

7. The printer of claim 1, wherein the protrusion extends from the carriage in a substantially downward direction from the carriage when the carriage is disposed in a printing orientation.

8. The printer of claim 1, further comprising:

a lubricating medium disposed on the first and second walls in the region where the first and second portions of the protrusion contact the first and second walls of the channel.

9. The printer of claim 1, wherein the third wall is approximately horizontal when the carriage is disposed in a printing orientation.

10. The printer of claim 1, wherein no portion of the protrusion makes contact with the third wall.

11. The printer of claim 1, the channel including an axis that is parallel to the path, the channel further comprising:

an extension for attaching the channel to the printer, the extension including a mounting surface that extends along a direction which is substantially parallel to the axis.

12. The printer of claim 1, the channel including an axis that is parallel to the path, the channel further comprising:

a extension for attaching the channel to the printer, the extension and the channel including bent portions that are substantially parallel to the axis.

13. A printer comprising:

a carriage including a protrusion extending from the carriage; and a channel for guiding the carriage along a path, the channel including a first wall and a second wall, the first and second walls being opposed to each other, the protrusion of the carriage extending between the first wall and the second wall, a first portion of the protrusion being in contact with the first wall, and a second portion of the protrusion being in contact with the second wall; wherein the carriage includes a center of gravity, and the carriage further comprising: a rotation limiting extension, wherein the rotation limiting extension and the protrusion are located on the same side of the center of gravity.

14. The printer of claim 13, further comprising:

a rotation limiting rail including a wall against which the rotation limiting extension makes contact.

15. The printer of claim 14, wherein the wall of the rotation limiting rail is substantially vertical when the carriage is disposed in a printing orientation.

16. The printer of claim 13, wherein the first and second portions of the protrusion are curved.

17. The printer of claim 13, the first wall being disposed at a first angle with respect to vertical and the second wall being disposed at a second angle with respect to vertical, wherein the first angle and the second angle are each less than 60 degrees when the carriage is disposed in a printing orientation.

18. The printer of claim 13, the first wall being disposed at a first angle with respect to vertical and the second wall being disposed at a second angle with respect to vertical, wherein the first angle and the second angle are each less than 45 degrees when the carriage is disposed in a printing orientation.

19. The printer of claim 13, wherein the first wall and the second wall are positioned at a non-perpendicular angle relative to each other.

20. The printer of claim 13, wherein gravity acts as a biasing mechanism to keep the protrusion of the carriage in contact with the first and second walls of the channel.

21. The printer of claim 13, wherein the protrusion extends from the carriage in a substantially downward direction from the carriage when the carriage is disposed in a printing orientation.

22. The printer of claim 13, further comprising:

a lubricating medium disposed on the first and second walls in the region where the first and second portions of the protrusion contact the first and second walls of the channel.

* * * * *